United States Patent [19]

St. Laurent

[11] Patent Number: 4,896,854

[45] Date of Patent: Jan. 30, 1990

[54] BOW HOLDER

[76] Inventor: Louis S. St. Laurent, 2948 Earl, Warren, Mich. 48092

[21] Appl. No.: 285,545

[22] Filed: Dec. 15, 1988

[51] Int. Cl.[4] ..... A47F 3/44

[52] U.S. Cl. ..... 248/156; 248/309.1

[58] Field of Search ..... 248/156, 176, 126, 122, 248/178, 165, 309.1; 124/23 R, 1; 211/64

[56] References Cited

U.S. PATENT DOCUMENTS

| | | | |
|---|---|---|---|
| 2,275,870 | 3/1942 | Sheldon | 248/122 X |
| 3,209,442 | 10/1965 | Watson | 124/23 X |
| 3,241,798 | 3/1966 | Nestor | 248/156 X |
| 3,256,872 | 6/1966 | Koser | 124/23 R |
| 3,286,961 | 11/1966 | Mandolare | 248/126 X |
| 3,584,820 | 6/1971 | Butcher | 248/122 |
| 3,612,454 | 10/1971 | Linn | 248/156 X |
| 3,991,780 | 11/1976 | Maroski | 248/122 X |
| 4,144,971 | 3/1979 | Balibrea | 211/64 |
| 4,331,311 | 5/1982 | Russell | 248/176 |
| 4,360,179 | 11/1982 | Roberts | 248/176 X |
| 4,474,296 | 10/1984 | Hartman | 211/13 |
| 4,542,873 | 9/1985 | Matherly | 248/218.4 |
| 4,729,363 | 3/1988 | Skyba | 124/23 R |

*Primary Examiner*—J. Franklin Foss

*Attorney, Agent, or Firm*—Basile and Hanlon

[57] ABSTRACT

A bow holder for supporting various types of bows in an upright position is disclosed. The holder comprises a support member having an upper, middle and lower section. The bottom portion of the lower section engages the holder for selectively mounting it to various surfaces, including a hunting seat or the ground. An upper bow receptacle is angularly disposed to the upper section, and a lower bow receptacle is angularly disposed to the middle section. The upper section is joined to the middle section at an interior obtuse angle less than 180°. In one embodiment, the middle section is joined to the lower section at an exterior obtuse angle less than 180°. In a second embodiment, adjacent ends of the middle and lower support member sections have matingly engageable serrated edges which are releasably secured. The middle section of this second embodiment can be adjustably disposed with respect to the lower section at various exterior angular orientations.

15 Claims, 3 Drawing Sheets

BOW HOLDER

BACKGROUND OF THE INVENTION

1. Field of the Invention

The present invention relates to holders for archery bows, and particularly to holders which support bows in an upright position on different surfaces, including hunting seats or the ground.

2. Description of the Relevant Art

It is known in the art to provide a bow holder which supports a bow in an upright position. U.S. Pat. No. 4,360,179 issued to Roberts discloses an archery bow stand with upper and lower receptacles, a leg assembly near the middle of the stand arm, and a rear leg means.

U.S. Pat. No. 4,144,971 issued to Balibrea discloses a gun caddy which has a rigid support shaft, a base member, and stake members which make the caddy earth-engageable.

The bow stands of the types disclosed are insufficient for a variety of reasons. They were designed to accommodate earlier bow designs, sometimes including compound bows. None of the designs are suited to hold overdraw bows. The stands are often difficult to assemble and transport, since they are in several pieces. Most stands lack versatility in that they can rarely be used in both a hunting seat and in the ground.

Thus, it would be desirable to have a bow holder which can accommodate all types of bows, needs very little assembly, and can be used on both a hunting seat and in the ground.

SUMMARY OF THE INVENTION

The present invention has overcome the deficiencies noted above, and provides a bow holder having an interior side and an exterior side, the holder comprising a support member having an upper section, a middle section and a lower section. Means are provided for engaging the lower section for selectively mounting the holder. An upper bow receptacle is angularly disposed to the upper section, a lower bow receptacle is angularly disposed to the middle section and both receptacles face the interior side. The upper section is joined to the middle section at an interior obtuse angle less than 180°. The bow holder will support a bow in an upright position, with the lower bow receptacle supporting the end of the bow, and the upper bow receptacle supporting the bow at some medial position on its arm.

BRIEF DESCRIPTION OF THE DRAWINGS

Further objects, features and advantages of the present invention will become apparent from the following detailed description and drawings, in which.

DETAILED DESCRIPTION OF THE PREFERRED EMBODIMENTS

Figure 1:
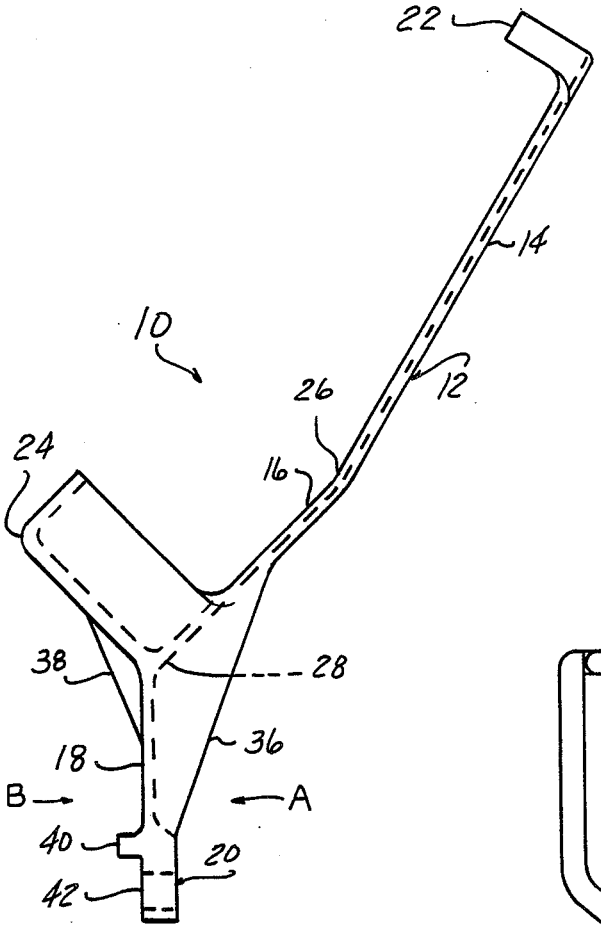
FIG. 1 is a front view of a first embodiment of the present invention.
Figure 7:
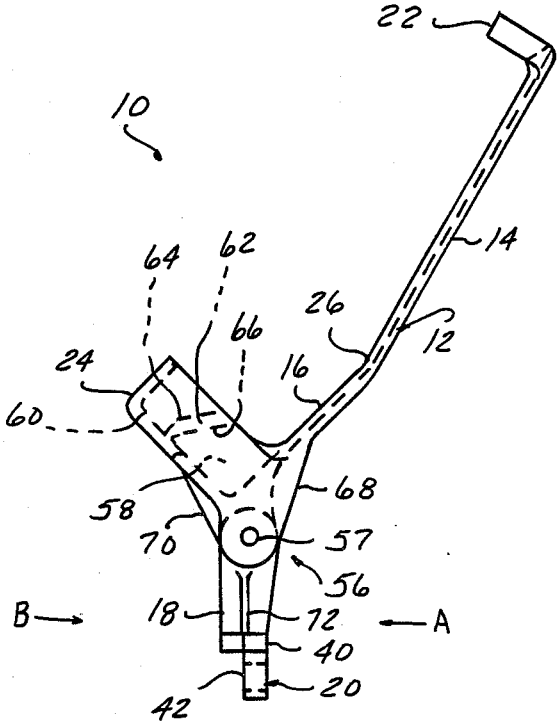
FIG. 7 is a front view of a second embodiment of the present invention.

Referring now to the drawings, and more particularly to FIGS. 1 and 7, there are shown two embodiments of the bow holder of the present invention, designated 10, For ease and clarity of orientation, the exterior side of holder 10 will be designated A and the interior side will be designated B. The bow holder 10 comprises a support member 12 which has an upper section 14, a middle section 16 and a lower section 18. Means 20 for engaging the lower section 18 are provided. The engaging means 20 will selectively mount the holder 10 to various surfaces, including hunting seats and the ground (not shown). The holder 10 has an upper bow receptacle 22 which is angularly disposed to the upper section 14, and a lower bow receptacle 24 which is angularly disposed to the middle section 16. Both bow receptacles 22, 24 face the interior side B. The upper section 14 is joined to the middle section 16 at an interior obtuse angle 26 less than 180°. The holder 10 supports a bow (not shown) in an upright position. The lower bow receptacle 24 supports the end of a bow and can accommodate the pulley found on a compound bow. The upper bow receptacle 22 supports the bow at some medial position on the bow arm.

The first embodiment of the bow holder 10, as seen in FIG. 1, has the middle support member section 16 joined to the lower support member section 18 at an exterior obtuse angle 28 less than 180°. The bow is held by the lower bow receptacle 24 and forced in toward the interior angle 26. The portion of the bow arm held by the upper bow receptacle 22 and the upper support member section 14 is also forced in toward the interior angle 26. Thus, the bow is somewhat cradled on the support member 12 and is not likely to be dislodged.

Figure 2:
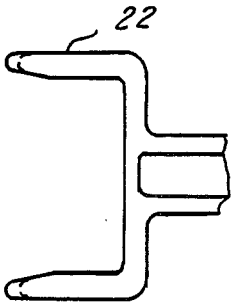
FIG. 2 is a top view of the upper bow receptacle of the present invention.
Figure 3:
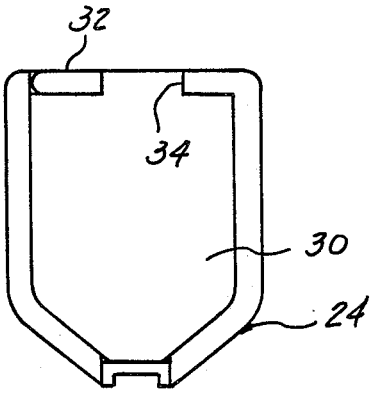
FIG. 3 is a top view of the lower bow receptacle of the first embodiment of the present invention.

In the first preferred embodiment, the interior angle 26 is approximately equal to the exterior angle 28. The upper bow receptacle 22 and the lower bow receptacle 24 are essentially perpendicular to the upper support member section 14 and middle support member section 16, respectively. The upper bow receptacle 22, as can best be seen in FIG. 2, is essentially U-shaped. The lower bow receptacle 24, as can be seen in FIG. 3, is essentially U-shaped and has a closed bottom 30. It has a wall 32 that is opposite the middle support member section 16, and a slot 34 formed in the wall 32.

Figure 4:
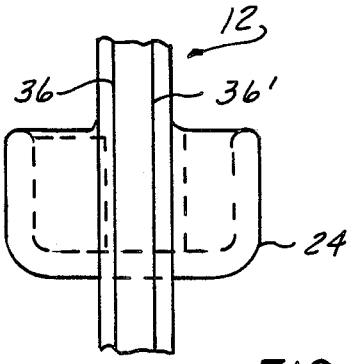
FIG. 4 is a partially cut-away detail view of the first embodiment of the present invention taken from the exterior side.
Figure 5:
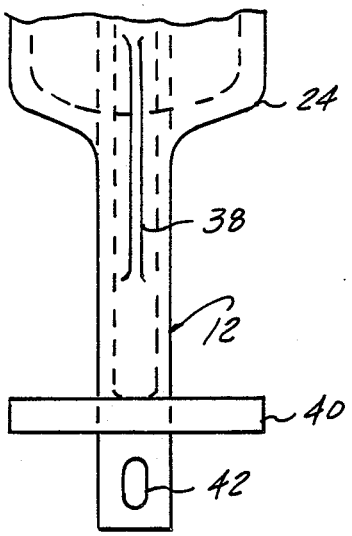
FIG. 5 is a partially cut-away detail view of the first embodiment of the present invention taken from the interior side.

On the exterior side A of the holder 10, there is at least one flange 36 on the support member 12. The flange 36 is used for stiffening the support member 12 when it is made out of a somewhat flexible material, such as plastic. When the bow holder 10 is made of metal, stiffeners normally are not needed. It is to be understood that the holder 10 may be made of any suitable material, with or without stiffeners, as necessary. As seen in FIGS. 1 and 4, two flanges 36, 36' extend from a medial position on the upper bow receptacle 22 to a medial position on the lower support member section 18. On the interior side B, at least one stiffening web 38 extends from a medial position on the lower bow receptacle 24 to a medial position on the lower support member section 18, as seen in FIGS. 1 and 5.

A lateral support ledge 40 is perpendicularly disposed to the lower support member section 18, and in the first preferred embodiment, the flanges 36, 36' start at the top of the upper bow receptacle 22, and flanges 36, 36' and the stiffening web 38 extend to a point at or above the ledge 40.

Figure 6:
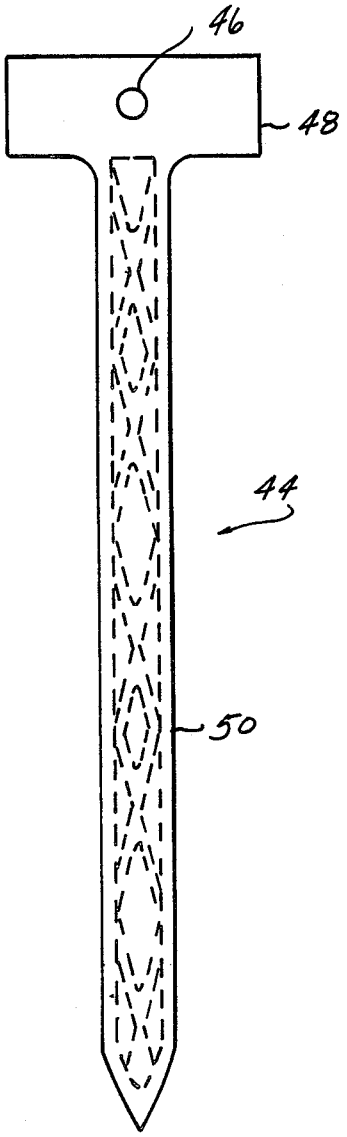
FIG. 6 is a front view of the peg of the present invention.

The engaging means 20 comprises a nut and through bolt (not shown) receivable in an aperture 42 defined in the lower support member section 18 at the end which is opposite the exterior angle 28. The engaging means 20 may further comprise a peg 44, as shown in FIG. 6. The peg 44 has a head 48 defining an aperture 46 and a shaft 50 extending from the head 48. The nut and bolt (not shown) are adapted to join the peg 44 to the lower support member section 18 through the respective apertures 46, 42. The peg 44 is adapted to secure the bow holder 10 to a selected portion of ground (not shown) by driving the peg 44, with the holder 10 attached, into the ground.

The second embodiment of the holder 10, as shown in FIG. 7, has the same basic elements as the first embodiment, namely the support member 12 with upper, middle, and lower sections 14, 16 and 18, respectively, engaging means 20, an upper and lower bow receptacle 22, 24, respectively, and the upper section 14 joined to the middle section 16 at an interior angle 26. However, several elements are different.

Figure 10:
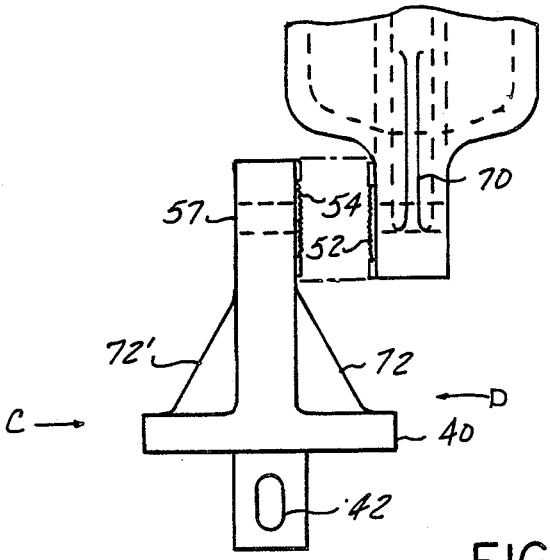
FIG. 10 is an exploded, partially cut-away detail view of the second embodiment taken from the interior side.

The adjacent ends of the support member middle and lower sections, 16 and 18 respectively, have matingly engageable serrated edges, 52 and 54, respectively, as shown in FIG. 10. Means 56 for releasably securing the adjacent edges 52, 54 are provide such that the middle section 16 can be adjustably disposed with respect to the lower section 18 at various angular orientations. In the second preferred embodiment, a bolt and wing nut (not shown) receivable through aperture 57 are used as the securing means 56. As in the first embodiment, the bow receptacles 22, 24 are essentially perpendicular to their respective sections 14, 16, and the upper bow receptacle 22 is essentially U-shaped as seen in FIG. 2.

Figure 8:
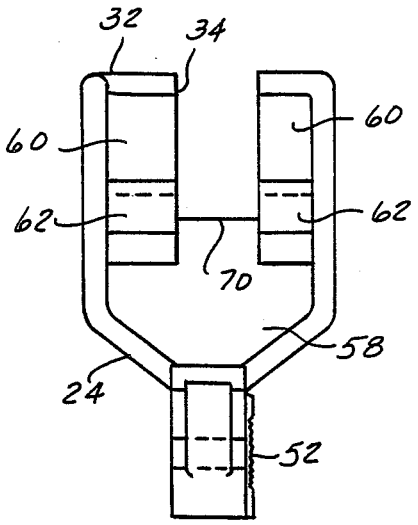
FIG. 8 is a top view of the lower bow receptacle of the second embodiment of the present invention.

In FIG. 8, there is shown the lower bow receptacle 24 of the second embodiment. This receptacle 24 is especially suited for use with an overdraw bow. It is to be understood that the lower receptacle 24, shown in FIG. 8, may also be used in the first embodiment, and the receptacle 24, shown in FIG. 3, may also be used in the second embodiment.

Referring now to FIGS. 7 and 8, the receptacle 24 is essentially U-shaped, with a partially open bottom 58 and a partially closed bottom 60. There is a wall 32 opposite the middle section 16, and a slot 34 formed in the wall. The partially open bottom 58 and slot 34 accommodate a pulley (not shown) found on bows such as compound and overdraw bows. The lower bow receptacle 24 also has slanted walls 62 on both sides of the slot 34. The walls 62 extend from a medial position on the partially closed bottom 60, closer to the end of the receptacle 24 opposite the middle section 16, to a medial position on the top of the bow receptacle 24 closer to the end of the bow receptacle 24 adjacent the middle section 16. The face 64 of the wall 62 which is on the side of the closed bottom 60 turns downward to hit the closed bottom 60 at a 90° angle. The face 66 of the wall 62, which is on the side of the open bottom 58, hits the bottom at an angle less than 90°. If the face 64 did not turn downward, but rather followed its line to the closed bottom 60, the angle at which it hit the bottom 60 would be equal to the angle at which face 66 hits the bottom. The slanted walls 62 and closed bottom 60 on either side of the slot 34 are adapted to receive the portions of a bow which are on either side of a bow pulley.

The second embodiment has a lateral support ledge 40 perpendicularly disposed to the lower support member section 18, as shown in FIGS. 7 and 10. On the exterior side A, at least one stiffening flange 68 is formed on the support member 12. The flange 68 extends from a medial position on the upper bow receptacle 22 to a medial position on the middle support member section 16. On the interior side B, at least one stiffening web 70 extends from a medial position on the lower bow recptacle 24 to a medial position on the middle support member section 16. The lower support member section 18 has a front D and a back C, and on the front and back, at least one stiffening web 72 extends from a medial position on the lower section 18 to a medial position on the ledge 40.

Figure 9:
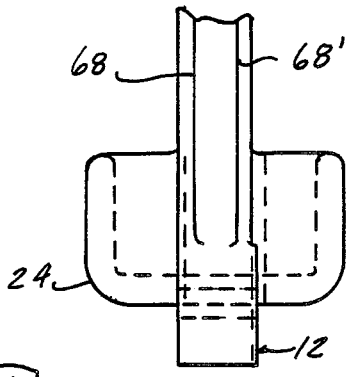
FIG. 9 is a partially cut-away detail view of the second embodiment of the present invention taken from the exterior side.

In the second preferred embodiment, as seen in FIGS. 7, 9 and 10, two flanges 68, 68' extend on either side of the support member 12, from the top of the upper bow receptacle 22 to the bottom of the serrated edge 52 on the middle section 16. The stiffening web 70 extends from the open bottom 58 of the lower receptacle 24 to the bottom of the serrated edge 52. One stiffening web 72, 72' extends on both front D and back C from below the serrated edge 54 on the lower section 18 to a position on the ledge 40 closest to the edge opposite the lower section 18.

The engaging means 20 comprising the nut, through bolt and peg 44 functions in the same manner as described for the first embodiment.

It is to be understood that the foregoing description is merely exemplary and not limitative.

What is claimed is:

1. A bow holder having an interior side and an exterior side, the bow holder comprising:

a support member having an upper section, a middle section, and a lower section;

means for engaging the lower section for selectively mounting the holder; and an upper bow receptacle being angularly disposed to the upper section, and a lower bow receptacle being essentially U-shaped and having a closed bottom, a wall opposite the middle section, and a slot formed in the wall, the lower bow receptacle being angularly disposed to the middle section, both receptacles facing the interior side, the upper section being joined to the middle section at an interior obtuse angle less than 180°, the middle support member section being joined to the lower section at an exterior obtuse angle less than 180°;

whereby a bow is supported, in an upright position, at the bow's end by the lower bow receptacle and, at a medial position on the bow, by the upper bow receptacle.

2. The bow holder as defined in claim 1 wherein the interior angle is approximately equal to the exterior angle.

3. The bow holder as defined in claim 1 wherein the bow receptacles are essentially perpendicular to their respective sections.

4. The bow holder as defined in claim 1 wherein on the exterior side at least one flange for stiffening is formed on the support member, the flange extends from a medial position on the upper bow receptacle to a medial position on the lower support member section, and on the interior side, at least one stiffening web extends from a medial position on the lower bow receptacle to a medial position on the lower support member section.

5. The bow holder as defined in claim 4 wherein a lateral support ledge is perpendicularly disposed to the lower support member section, and the flange and the stiffening web extend to a point above the ledge.

6. The bow holder as defined in claim 1 wherein a lateral support ledge is perpendicularly disposed to the lower support member section.

7. The bow holder as defined in claim 1 wherein the engaging means comprises a nut and a through bolt receivable in an aperture defined in the lower support member section at the end opposite the exterior angle.

8. The bow holder as defined in claim 7 wherein the engaging means further comprises a peg, the peg having a head defining an aperture, and a shaft extending from the head, wherein the nut and through bolt are adapted to join the peg to the lower support member section through the respective apertures the peg being adapted to secure the bow holder to a selected portion of ground.

9. A bow holder having an interior side and an exterior side, the bow holder comprising:

a support member having an upper section, a middle section, and a lower section;

means for engaging the lower section for selectively mounting the holder;

an essentially U-shaped upper bow receptacle being angularly disposed to the upper section, and an essentially U-shaped lower bow receptacle being angularly disposed to the middle section, the lower bow receptacle having a partially open bottom adapted to receive a pulley on a bow, a wall opposite the middle section, and a slot formed in the wall, the lower bow receptacle further having slanted walls on both sides of the slot, the slanted walls adapted to receive portions of the bow on either side of the pulley, both receptacles facing the interior side, the upper section being joined to the middle section at an interior obtuse angle less than 180°;

adjacent ends of the support member middle and lower sections having matingly engageable serrated edges; and means for releasably securing the adjacent edges such that the middle section can be adjustably disposed with respect to the lower section at various exterior angular orientations;

whereby a bow is supported, in an upright position, at the bow's end by the lower bow receptacle and, at a medial position on the bow, by the upper bow receptacle.

10. The bow holder as defined in claim 9 wherein the bow receptacles are essentially perpendicular to their respective sections.

11. The bow holder as defined in claim 9 wherein the engaging means comprises a nut and a through bolt receivable in an aperture defined in the lower support member section at the end opposite the serrated edge.

12. The bow holder as defined in claim 11 wherein the engaging means further comprises a peg, the peg having a head defining an aperture, and a shaft extending from the head, wherein the nut and through bolt are adapted to join the peg to the lower support member section through the respective apertures, the peg being adapted to secure the bow holder to a selected portion of ground.

13. A bow holder having an interior side and an exterior side, the bow holder comprising:

a support member having an upper section, a middle section, and a lower section;

means for engaging the lower section for selectively mounting the holder;

an upper bow receptacle being angularly disposed to the upper section, and a lower bow receptacle being angularly disposed to the middle section, both receptacles facing the interior side, the upper section being joined to the middle section at an interior obtuse angle less than 180°;

adjacent ends of the support member middle and lower sections having matingly engageable serrated edges; and means for releasably securing the adjacent edges such that the middle section can be adjustably disposed with respect to the lower section at various exterior angular orientations; and a lateral support ledge perpendicularly disposed to the lower support member section;

whereby a bow is supported, in an upright position, at the bow's end by the lower bow receptacle and, at a medial position on the bow, by the upper bow receptacle.

14. The bow holder as defined in claim 13 wherein on the exterior side at least one flange for stiffening is formed on the support member, the flange extends from a medial position on the upper bow receptacle to a medial position on the middle support member section, and on the interior side, at least one stiffening web extends from a medial position on the lower bow receptacle to a medial position on the middle support member section.

15. The bow holder as defined in claim 14 wherein the lower support member section has a front and back, and on the front and back, at least one stiffening web extends from a medial position on the lower section to a medial position on the ledge.

* * * * *